US012344964B2

(12) United States Patent
Korkmaz et al.

(10) Patent No.: US 12,344,964 B2
(45) Date of Patent: Jul. 1, 2025

(54) PROTECTIVE WOVEN FABRIC

(71) Applicant: Sanko Tekstil Isletmeleri San. Ve Tic. A.S., Inegol—Bursa (TR)

(72) Inventors: Fatma Korkmaz, Inegol—Bursa (TR); Erdogan Bariş Özden, Inegol—Bursa (TR); Mustafa Zeyrek, Inegol—Bursa (TR); Fatih Konukoğlu, Inegol—Bursa (TR)

(73) Assignee: Sanko Tekstil Isletmeleri San. Ve Tic. A.S., Inegol—Bursa (TR)

( * ) Notice: Subject to any disclaimer, the term of this patent is extended or adjusted under 35 U.S.C. 154(b) by 0 days.

(21) Appl. No.: 17/684,546

(22) Filed: Mar. 2, 2022

(65) Prior Publication Data

US 2022/0290338 A1 Sep. 15, 2022

(30) Foreign Application Priority Data

Mar. 2, 2021 (EP) ..... 21160233

(51) Int. Cl.
*D03D 15/47* (2021.01)
*D02G 3/44* (2006.01)
(Continued)

(52) U.S. Cl.
CPC ..... *D02G 3/442* (2013.01); *D03D 15/283* (2021.01); *D03D 15/56* (2021.01)

(58) Field of Classification Search
CPC ..... D02G 3/442; D02G 3/328; D03D 15/283; D03D 15/56; D03D 1/0035; D03D 15/573;
(Continued)

(56) References Cited

U.S. PATENT DOCUMENTS 3,071,919 A * 1/1963 Lord ..... F16L 11/08 57/211
3,328,226 A * 6/1967 Wiley ..... D06N 3/0015 442/67
(Continued)

FOREIGN PATENT DOCUMENTS

JP 2017-36526 2/2017
KR 20200102224 A 8/2020

OTHER PUBLICATIONS

European Search Report and written opinion issued by the EPO on Aug. 19, 2022 for corresponding European patent application No. 22159822.0.

(Continued)

*Primary Examiner* — Robert H Muromoto, Jr.

(57) ABSTRACT

A woven fabric having warp yarns and weft yarns, wherein said warp yarns and said weft yarns comprise a core and a sheath, said core comprising a first core component and a second core component, wherein the first core component has a breaking tenacity, measured with DIN EN ISO 2062, of at least 6 g/den, more preferably of at least 10 g/den, more preferably of at least 14 g/den, even more preferably of at least 20 g/den, wherein the second core component comprises elastomeric elements, and wherein elasticity of the fabric in warp direction is at least 20% (measured according to ASTM D3107) and elasticity of the fabric in weft direction is at least 20% (measured according to ASTM D3107).

23 Claims, 1 Drawing Sheet

(51) Int. Cl.
*D03D 15/283* (2021.01)
*D03D 15/56* (2021.01)
*D02G 3/04* (2006.01)

(58) Field of Classification Search
CPC .. D03D 15/47; D03D 15/513; D10B 2331/10; D10B 2401/061; D10B 2501/04
See application file for complete search history.

(56) References Cited

U.S. PATENT DOCUMENTS 3,448,573 A * 6/1969 West ..... D02G 3/02 264/210.8
3,838,561 A * 10/1974 Munting ..... D02G 3/447 57/902
3,858,386 A * 1/1975 Stofan ..... D01D 5/088 428/401
3,966,867 A * 6/1976 Munting ..... D02G 3/447 264/210.7
4,228,118 A * 10/1980 Wu ..... D01F 6/04 264/210.8
4,356,138 A * 10/1982 Kavesh ..... D01D 5/00 264/210.8
5,171,504 A * 12/1992 Cuculo ..... D01D 5/084 264/210.4
5,644,907 A * 7/1997 Kolmes ..... D02G 3/442 57/212
5,806,295 A * 9/1998 Robins ..... D02G 3/38 57/220
6,155,084 A * 12/2000 Andrews ..... A41D 19/01505 66/65
10,465,316 B2 * 11/2019 Bagwell ..... D04B 21/16
11,000,443 B2 * 5/2021 Gallagher ..... A61H 7/001
11,680,182 B2 * 6/2023 Agirman ..... D06M 15/233 442/148
2005/0155336 A1 * 7/2005 Robins ..... D02G 3/441 57/210
2006/0048497 A1 * 3/2006 Bloch ..... D02G 3/442 57/230
2008/0251960 A1 * 10/2008 Harding ..... B29C 55/18 264/119
2009/0252961 A1 * 10/2009 Eguchi ..... D02G 3/36 428/373
2011/0167545 A1 * 7/2011 Garcia ..... D04B 1/14 2/455
2011/0319585 A1 * 12/2011 Uehara ..... C08J 5/18 264/234
2012/0244771 A1 * 9/2012 Tharpe, Jr. ..... D02G 3/32 57/210
2013/0101781 A1 * 4/2013 Lee ..... D02G 3/36 428/221
2014/0047625 A1 * 2/2014 Thatcher ..... D06M 15/277 2/458
2014/0259285 A1 * 9/2014 Andrews ..... D04B 7/34 2/167
2014/0283559 A1 * 9/2014 Andrews ..... D04B 1/28 2/167
2015/0176160 A1 * 6/2015 Lee ..... D03D 15/49 428/221
2015/0181956 A1 * 7/2015 Andrews ..... A41D 19/0006 2/167
2016/0273135 A1 * 9/2016 Mittal ..... D03D 15/49
2016/0281275 A1 * 9/2016 Ozden ..... D03D 15/56
2017/0354907 A1 * 12/2017 Ray ..... D03D 15/37
2019/0186055 A1 * 6/2019 O'Hara ..... D03D 15/217
2019/0203385 A1 * 7/2019 Agzikara ..... D02G 3/324
2020/0032427 A1 * 1/2020 Konukoglu ..... D01F 8/14
2020/0056307 A1 * 2/2020 Konukoglu ..... D02G 3/32
2020/0095451 A1 * 3/2020 Agirman ..... C08K 5/19
2021/0164131 A1 * 6/2021 Ackerman ..... D01F 6/92
2022/0290338 A1 * 9/2022 Korkmaz ..... D03D 15/56

OTHER PUBLICATIONS

International Search Report and written opinion issued by the EPO on Jul. 13, 2022 for corresponding International patent application No. PCT/EP2022/055312.
European Search Report and written opinion issued by the EPO on Aug. 27, 2021 for priority European patent application No. 21160233.9 (withdrawn).
Office Action issued by the Japanese patent office for JP application No. 2022-560459 on Nov. 28, 2023.
S. Md Mominul Alam and Md. Golam Kibria, Sustainable Heat Setting Process In Stentor For Textile Industry, Materialstoday: Proceedings, https://doi.org/10.1016/j.matpr.2022.01.211.

* cited by examiner

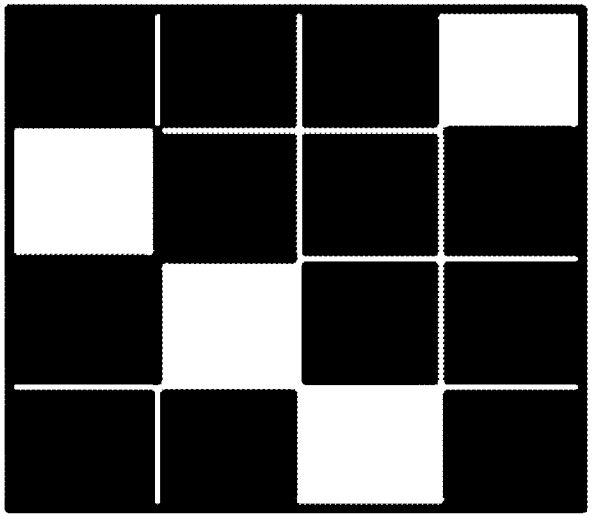

PROTECTIVE WOVEN FABRIC

This application claims priority to and the benefit of European Application No. 21160233.9 filed on Mar. 2, 2021, the content of which is incorporated herein by reference in its entirety.

FIELD OF THE INVENTION

The present invention relates to protective woven fabrics and the manufacture thereof, namely to woven fabrics having resistance to abrasion, and in particular to elastic woven fabric resistant to abrasion.

BACKGROUND ART

Abrasion resistant fabrics, particularly in garments for use with motorcycles are known in the art. In particular, protective garments that consists of fabrics provided with additional hard or reinforcing materials are known. These hard materials usually provide an uncomfortable feeling to the wearer. These garments and fabrics are also often unattractive and unappealing.

There thus is the need for protective fabrics and garments having a comfortable feeling for the user, while providing an effective protection from abrasion for the user, i.e. comfortable and aesthetically acceptable fabrics and garments that are also provided with a high abrasion resistance.

SUMMARY OF THE INVENTION

An aim of the present invention is to solve the problems of the prior art, by providing a protective fabric that, when tailored into a garment, is comfortable and attractive for the wearer of the garment.

A further aim of the present invention is to provide such a fabric, that is easy to produce and to treat, and in particular, to dye.

These and other aims are achieved by a woven fabric and a garment according to one or more of the enclosed claims.

Therefore, an object of the present invention is a woven fabric according to the claims.

In particular, an aspect of the present invention relates to a woven fabric having warp yarns and weft yarns, wherein said warp yarns and said weft yarns comprise a core and a sheath, said core comprising a first core component and a second core component, wherein first core component has a breaking tenacity of at least 6 g/denier (52.98 cN/tex), more preferably of at least 10 g/den (88.30 cN/tex), most preferably of at least 14 g/den, while the second core component comprises one or more elastomeric elements, and wherein elasticity of the fabric (i.e. the fabric stretch) in warp direction is at least 20% (measured according to ASTM D3107) and elasticity of the fabric (i.e. the fabric stretch) in weft direction is at least 20%.

As known, in the field of textiles, an elastomeric element (or filament) can be stretched at least up to two times its original length. Preferably, the second core component can be stretched 400% more than of its original length. In other words, there is at least one method that allows, at room temperature and without chemical treatments, to stretch the second core up to a length that is five times its original length, i.e. elongation at break is at least 200%, preferably at least 400%. Exemplary testing machine suitable for testing elongation at break of elastic yarns are known in the art, e.g. Uster Tensorapid apparatuses. In a preferred embodiment, the breaking tenacity of the first core component is at least 14 g/denier, even more preferably 20 g/denier, i.e. 20 grams per denier, that is at least 176.60 cN/tex.

The first core component can comprise a single element or multiple elements, e.g. can be a single filament, or it an comprise multiple filaments. Multiple filaments can be coalesced (filaments that are stuck together) or uncoalesced (separate) filaments. Unless specified otherwise, properties of the first core component are thus referred to the sum of all the elements of the first core components. As an example, the count of the first component is the sum of the counts of all the elements. Breaking tenacity is discussed as a relative property, i.e. as a function of the denier of the component. As a result, the elements of the first component can be tested together or separately and the relevant results combined.

The first core component is preferably made of one or more UHMWPE filaments. UHMWPE (i.e. ultra-high-molecular-weight polyethylene) is a material known in the art. The first core component is preferably used in the core of both warp and weft yarns and provides a high abrasion resistance to the fabric (and thus to the final garment), while presence of the sheath prevents the UHMWPE from (uncomfortably) touching the skin of the user and from being visible. UHMWPE filaments are the most preferred material for the first core component. In fact, it was surprisingly found that they have high tenacity and abrasion resistance, while still preventing grin through. In other words, in normal use said filaments remain centered in the core portion of warp/weft yarns within the sheath, without surfacing, even after several cycles of elongation and retraction of the fabric.

Similarly, the second core component can consist of a single element or it can comprise a plurality of elements, e.g. a single filament or a plurality of filaments.

In addition to that, the use of elastomeric filaments in both warp and weft cores provides elasticity in every direction to the final fabric. Such an effect further provides a garment that is comfortable to wear, especially for motorcycle use; in fact, elasticity in both direction allows the fabric to extend in warp and weft direction, so that the garment to move with the body of the user. If the garment is a pair of trousers, the user is not limited or restrained during a sitting position, avoiding an uncomfortable feeling especially in the knees and hips areas. According to a possible aspect, the fabric has a single layer weave, preferably selected from sateen, twill and canvas. These weaves, in particular sateen and twill, can provide the usual denim look to the fabric. The most preferred weave is twill, preferably a 3/1 twill weave.

According to a possible aspect, the first core component and the second core component are connected together by intermingling, twisting or co-feeding. In a preferred embodiment, the first core component comprises, preferably consists of, a plurality of UHMWPE filaments and the second core component comprises, preferably consists of, a plurality of elastomeric filaments. In alternative to the UHMWPE other filaments such as aramid filaments, liquid crystal polymer filaments, high strength polyester or polyamide filaments having at least 6 g/den, preferably at least 10 or 14 or 20 g/den breaking tenacity may be used.

Suitable elastomeric filaments include elastane and rubber, preferably elastane. Before combining the abrasion resistant filaments and the elastomeric filaments, the latter are drafted in a ratio within the range of 1.5:1 to 6:1, i.e. they are drafted by 50% to 500% more than their initial length.

According to a possible aspect, the sheath comprises, preferably consist of, staple fibers. Preferred fibers for the sheath are natural fibers, more preferably cotton fibers. Other possible natural fibers are e.g. wool and linen. Synthetic materials can be also used fort the sheath such as polyester and polyamide. The sheath, in particular a cotton sheath, provides a soft and natural feel on the skin of a user. In addition to that, a cotton surface can be dyed (even if undyed embodiments are possible) e.g. with indigo, black or other dyestuffs e.g. by ecru dyeing, rope dyeing, slash dyeing or other suitable processes.

The combination of above materials, and preferably also the coupling of core components, also provides a washable fabric, such as classic denim fabric that can undergo several different washes, without surfacing of the core, i.e. so that the visible surface of the yarn is substantially 100% the material of the sheath, e.g. 100% cotton.

According to a possible aspect, elasticity of the fabric in weft direction is at least 30%. According to a possible aspect, the elasticity in warp direction is comprised between 25% and 40%.

According to a possible embodiment, the same yarn is used for the warp yarns and for the weft yarns of the fabric. In possible alternative solutions, the warp yarns are different from the weft yarns. In other words, according to a possible solution, the warp yarns and the weft yarns are made from the same kind of yarn. It is however possible that the weft yarns have a different count with respect to the warp yarns and the nature of the core components are the same in warp and weft yarns.

According to a possible aspect, the count of the warp yarns and of the weft yarns is comprised between NE 4 and NE 80, more preferably between NE 8 and NE 60, even more preferably between NE 10 and NE 20. The final yarn is typically not combined with other yarns (e.g. via twisting), the count is thus preferably between NE 4/1 and NE 80/1, more preferably within NE 8/1 and NE 60/1, even more preferably between NE 10/1 and NE 20/1.

According to a possible aspect, the count of the first core component (i.e. the count of the only element, typically a filament, forming the first core component, or the sum of the counts of all the different elements of the first core component, typically the sum of all the filaments of the first core component) is comprised between 30 den and 500 den, more preferably between 60 and 200 den, even more preferably between 75 and 150 den.

According to a possible aspect, the count of the second core component (i.e. as per above the count of the only element forming the second core component or the sum of the counts of the different elements forming the second core component) is comprised between 20 and 500 den, more preferably between 40 and 200 den, even more preferably between 70 and 105 den.

According to a preferred aspect, the elements of the first core component (if more than one) are made from the same material and/or have the same count.

According to a preferred aspect, the elements of the second core component (if more than one) have are made from the same material and/or have the same count.

The element(s) of the first core component is/are made from a material different from the material of the element(s) of the second core component.

According to a preferred aspect, elongation at break of the first core component is less than 10%, more preferably less than 8%, tested with DIN EN ISO 2062. Preferably, this value applies also to each of the elements of the first core component.

Preferably, composition of the warp and weft yarn is as follows: the first core component is at least 10% of the weight of the yarn, second core component is at least 1.5% of the weight of the yarn, the sheath is at least 40% of the weight of the yarn. Preferred ranges (in weight) are as follows: first core component between 10% and 60%, second core component between 1.5% and 40%, sheath between 38.5% or 40% and 88.5%.

According to a possible aspect, the warp density of the final fabric is between 15 and 70 warps/cm, and the weft density is between 15 and 50 wefts/cm. Preferred embodiments have warp density between 20 and 60 warps/cm, and/or weft density between 18 and 40 wefts/cm.

High tenacity yarns, in particular UHMWPE yarns, have usually low melting/softening points. In particular, typically UHMWPE has a melting point of about 120° C.-140° C. As a result, according to preferred embodiments, the fabric is not heat set. More in general, during production of the fabric, it is preferably avoided any heat treatment causing heating of the fabric to above about 100° C.-110° C. Preferably, if the fabric is dyed, dying is performed at lower than 100° C. temperature or at room temperature.

In this regards, if heat setting is not performed, the weave is chosen so that shrinking of the final garment at washing is reduced. Preferred fabric use the densities and counts as above discussed, preferably having weight between 9 and 22 oz sq yd. As mentioned, a preferred weave is a twill, in particular a 3/1 twill, as the one shown in FIG. 1.

In particular, as shown in FIG. 1, this weave contains 4 different moves in the loom. Similarly, the sequence movements of 4 warp yarns and 4 weft yarns of the shown repeat unit all come together and make a pattern. After the 4th movement on the warp side, the pattern turns back to the first movement that warp and weft make together. All these warp and weft movements occurs in 4 different sequences in one report and after one full report the pattern comes back to first sequence of movements warp/weft make together.

The warp pattern from left to right is 2b/1a/1b, 1b/1a/2b, 1 a/3b, 3b/1a; wherein "a" is an under portion and "b" is an over portion According to a possible aspect, the warp tensile strength and weft tensile strength of the fabric, measured with ASTM D5034, typically ASTM D5034 G-E (i.e. fabric grab tensile tests with constant rate of extension testing machine) on a sample 15×10 cm (length x width), are greater than 50 Kg, more preferably greater than 80 Kg. In a preferred embodiment, at least the warp tensile strength (possibly also the weft tensile strength) is greater than 100 kg.

According to a possible aspect, the warp tear strength and weft tear strength, of the fabric, measured with ASTM D1424, typically on a sample 10×7.5 cm (length×width), and cutting die as per FIG. 1(*a*) of ASTM D1424, are greater than 10000 g, preferably higher than 13900 g.

A further aspect of the invention also relates to a garment, wherein at least a portion of the garment is made from the woven fabric according to any preceding claim.

A preferred embodiment of a garment is a pair of trousers.

A further aspect of the present invention relates to a yarn comprising a core and a sheath, the core comprising a first core component and a second core component, wherein the first core component has a breaking tenacity of at least 6g/den, more preferably at least 10 g/den, and the second core component comprises elastomeric elements.

Even more preferred embodiments have a breaking tenacity of the first core component of at least 20 g/den.

Preferably, as above discussed the first core component has elongation at break that is less than 10%, even more preferably less than 8%. Elongation at break of the second core component is preferably greater than 200%, even more preferably greater than 400%. Elongation at break of the first core component can be measured with DIN EN ISO 2062, while elongation at break of the second component can be measured with a suitable method, i.e. there is at least one method allowing, at room temperature, stretching of the second core component of at least 200%, more preferably of at least 400%. As discussed above, a preferred composition of the yarn is as follows: the first core component is between 10% and 60% of the weight of the yarn, the second core component is between 1.5% and 40% of the weight of the yarn, the sheath is between is between 40% and 88.5% of the weight of the yarn.

Preferably, the yarn has a count comprised between NE 4 and NE 80, more preferably between NE 8 and NE 60, even more preferably between NE 10 and NE 20, wherein count of the first core component is comprised between 30 den and 500 den, more preferably between 60 and 200 den, even more preferably between 75 and 150 den, wherein count of the second core component is comprised between 20 and 500 den, more preferably between 60 and 150 den, even more preferably between 70 and 105 den.

First and second core component are preferably combined with each other via co-feeding, twisting or intermingling.

The present yarn provides a resistance to abrasion to the final fabric, allowing to weave an elastic (stretchable) fabric, notwithstanding the presence of a high resistant component that is generally inelastic.

BRIEF DESCRIPTION OF THE DRAWINGS

FIG. 1 is a preferred weaving report for the present invention.

DETAILED DESCRIPTION OF PREFERRED EMBODIMENTS OF THE INVENTION

The present invention relates to a woven fabric having warp yarns and weft yarns.

The warp and weft yarns have the same structure, i.e. a core comprising a first core component and a second core component, the core being covered by a sheath.

Typically the core does not comprise other components. Preferably, the core comprises a single first core component and a single second core component.

It is not however excluded that the core comprises more than one first and/or more than one second yarn.

The first core component provides high resistance to abrasion and is typically a low elastic component.

In more detail, the fist core component, when tested with ISO 2062 has a breaking tenacity equal to or greater than 6 g/den, more preferably equal to or greater than 10 g/den, even more preferably greater than or equal to 14 g/den. Most preferred embodiments have breaking tenacity greater than or equal to 20 g/den, e.g. between 20 g/den and 50 g/den.

Preferably, the first core component has low elasticity, and thus low stretchability. In particular, according to a preferred solution, when, tested with DIN EN ISO 2062, elongation at break of the first core component is less than 10%, more preferably less than 8%.

The first core component may be a single filament yarn, or a yarn comprising a plurality of filaments and/fibers. The first core component is typically a UHMWPE yarn.

As previously discussed, the count of the first core component is comprised between 30 den and 500 den, more preferably between 60 and 200 den, even more preferably between 75 and 150 den.

The second core component is preferably a single filament yarn, or a yarn comprising a plurality of filaments. Preferred elastomeric yarns are elastane yarns. Count of the second core component is comprised between 20 and 500 den, more preferably between 40 and 200 den, even more preferably between 70 and 105 den.

As known, e.g. from ASTM D4849, an elastomeric yarn is a non-textured yarn which can be stretched repeatedly at room temperature to at least twice its original length and which after removal of the tensile force will immediately and forcibly return to approximately its original length.

The two core components are combined via twisting, intermingling or co-feeding. The co-feeding technique, better discussed below, is the preferred solution.

Twisting is a known technique. Twisting is usually performed so that the two core components (i.e. the first core component and the second core component) so as to obtain 20-2500 twists/meter, preferably 100-1000, twists/meter, and most preferably 300-600 twist per meter.

Intermingling can be carried out according to the known techniques of the art, such as open or closed intermingling jets. The system is arranged to provide a number of connecting points that is within the range of 20 to 200 points per meter, preferably 50 to 120 points per meter and most preferably 95 to 105. The method of measuring the number of intermingling point is by direct count of the combined fibers; in the latter method, the elastic core "yarn" is put on a black or dark surface and is inspected by eye, possibly with a magnifying glass, and the connecting points in a meter of yarn are manually counted.

Another possible connecting technique is co-feeding, also known as co-extrusion. With co-feeding, the two core components are forced through a restriction where the two yarns are compressed together to such a degree that they remain attached also after exiting the restriction. A suitable restriction is e.g. a "V"-shaped roll; in a preferred embodiment, the two core components are fed to a roll having a V-shape, in particular, they are fed together and forced into the bottom of the "V" where they are compressed together and remain bound. The co-fed yarns are preferably spun with the fibers of the sheath immediately after the co-feeding step.

The core is covered with a sheath, typically a sheath of staple fibers, typically cotton fibers.

The final warp and weft yarns have thus a count that is preferably comprised between NE 4 and NE 80, more preferably between NE 8 and NE 60, even more preferably between NE 10 and NE 20.

The warp and weft are woven via a single layer weave, preferably chosen between a canvas weave, a sateen weave and a twill weave.

Warp density of the final fabric is preferably comprised between 15 and 70 warps/cm, more preferably 20 and 50 warps/cm, even more preferably between 25 and 35 warps/cm.

Weft density of the final fabric is preferably comprised between 15 and 50 wefts/cm, more preferably between 20 and 30 wefts/cm.

Elasticity of the fabric in warp direction and in weft direction is at least 20%, measured according to ASTM D3107.

Please note that, in ASTM D3107, a sample may be stretched by means of a weight of 3.0 lb or 4.0 lb. It has been proven that there are no significant differences in the test results if either a 3.0 lb or 4.0 lb weight is used. In the present disclosure, stretch according to ASTM D3107 was measured by means of a 3.0 lb weight.

As a standard procedure for ASTM D3107, load is applied for 30 minutes.

The woven fabric of the present invention is thus characterized in that it has an elasticity, i.e. it can be stretched, in warp direction of at least 20%, preferably between 30% and 40%, and in that elasticity in the weft direction is at least 20%, more preferably at least 30%, even more preferably, at least 35%.

According to a preferred embodiment, the fabric of the present invention is a woven stretch fabric, both in warp and weft direction, as e.g. discussed in ASTM D4850, according to which a stretch woven fabric is a woven fabric which is capable of at least 20% stretch in either warp or filling direction, or both, under forces and conditions encountered in use, and almost complete recovery after removal of the force.

Preferably, elasticity of the fabric in weft direction is higher than the elasticity of the fabric in warp direction. It is however possible that the two values are substantially identical, or that elasticity of the fabric in warp direction is higher than the elasticity of the fabric in weft direction In view of the fact that the woven fabric of the present invention has high elasticity in both warp and weft direction, it can be defined as a "bi-stretch" woven fabric.

As used herein, "elasticity" values refer to the percentage of stretch in weft and in warp, measured according to ASTM D3107.

Another advantage of the bi-stretch fabric of the present invention is that, providing high elasticity in both warp and weft direction, an improvement of recovery, and a reduction of the growth, is obtained.

Test method EN 17092 provides five different classes of protective garments, according to their performance (from best to worst): AAA, AA, A, B and C. A protective fabric according to the present invention is at least an "A" fabric.

The invention will now be disclosed with reference to the following non-limiting examples.

EXAMPLES

TABLE 1

| | warp count (Ne) | warp 1st core count (den) | warp 2nd core count (den) | weft count Ne | weft 1st core count (den) | weft 2nd core count (den) | warp density (wrps/cm) | weft density (wfts/cm) |
|---|---|---|---|---|---|---|---|---|
| Ex. 1 | 16/1 | 75 | 70 | 20/1 | 75 | 105 | 35.8 | 22 |
| Ex. 2 | 10/1 | 150 | 70 | 10/1 | 150 | 70 | 25 | 18 |
| Ex. 3 | 10/1 | 150 | 70 | 10/1 | 150 | 70 | 25 | 18 |

TABLE 2

| | warp elasticity % | weft elasticity % | warp tensile strength (Kg) | weft tensile strength (Kg) | warp tear strength (g) | weft tear strength (g) |
|---|---|---|---|---|---|---|
| Ex. 1 | 30 | 61.6 | 131 | 82 | >13900 | >13900 |
| Ex. 2 | 29.6 | 42.4 | 152 | 147 | >13900 | >13900 |
| Ex. 3 | 26.4 | 24 | 138 | 100 | >13900 | >13900 |

Example 1

In example 1, the fabric has the features as per table 1. The warp yarns are different from the weft yarns. The warp yarns are a NE 16/1 yarn, having a 75 den UHMWPE yarn as a first core components coupled via co-feeding process to a 70 den elastane yarn as the second core component. Before coupling with the first core component, the elastane has a 3.7 draft. Composition of the warp yarn, by weight, is thus 71.5% cotton, 22.5% UHMWPE, 6% elastane. Twist multiple of the final warp yarn is 3.40, while the number of twists per meter of the final yarn is 535.

In the weft yarns, the elastane yarn is coarser (105 den), but the sheath is finer, so that the final yarn is finer (count of 20 NE).

Composition of the weft yarn, by weight, is thus 60.5% cotton, 28.2% UHMWPE, 11.3% elastane Twist multiple of the final weft yarn is 4.20, while the number of twists per meter of the final yarn is 828.

As known, Twist level (measured in twist per inch) =Twist Multiple*$\alpha\sqrt{}$yarn count (measured in English Cotton Number), i.e. Twist=$\alpha\sqrt{}$NE, wherein a is the twist multiple value.

The fabric has a twill 3/1 weave and, on the reed, has 20 warps/cm an 18.2 wefts/cm, while in the final fabric there are 35.8 warps /cm and 22 wefts/cm. Weight of the fabric is 12.2 oz.

The fabric was black overdyed, with black warp yarns and weft black yarns.

The fabric was tested with ASTM D3107 for elasticity, with ASTM D5034 for tensile strength, and with ASTM D1424 for tear strength. Results of the tests are as per table 2. Please note that testing machine for tear strength had a maximum weight applicable of 13900 grams (g). When tested at this maximum level, the fabric did not break, so tear strength is recited as greater than 13900 g.

Example 2

In example 2, the fabric has the features as per table 1. The warp yarns are identical to the weft yarns. The warp and weft yarns are NE 10/1 yarns, having a 150 den UHMWPE yarn as a first core components coupled via co-feeding process to a 70 den elastane yarn as the second core component. Before coupling with the first core component, the elastane has a 3.7 draft. Composition of the warp and weft yarns, by weight, is thus 68% cotton, 28.2% UHMWPE, 3.8% elastane.

Twist multiple of the final warp and weft yarns is 4.20, while the number of twists per meter of the final yarns is 523.

The fabric has a twill 3/1 weave and, on the reed, has 18 warps/cm an 14.2 wefts/cm, while in the final fabric there are 25 warps /cm and 18 wefts/cm. Weight of the fabric is 14.5 oz.

The warp yarns of the fabric were indigo dyed.

The fabric was tested with ASTM D3107 for elasticity, with ASTM D5034 for tensile strength, and with ASTM D1424 for tear strength. Results of the tests are as per table 2. Please note that testing machine for tear strength had a maximum weight applicable of 13900 grams (g). When tested at this maximum level, the fabric did not break, so tear strength is recited as greater than 13900 g.

When tested with EN 17092, this fabric was classified as an AAA fabric.

Example 3

Fabric of example 3 uses the same yarns and the same weave of example 2. The dying technique is however different. In particular the fabric was black overdyed, with black warp yarns and black weft yarns. Due to the different dyeing technique, values of elasticity, strength and fabric weight are different with respect to example 2, (weight being 13.3 oz).

A fabric according to the present invention tailored into a garment, in particular a protective fabric for motorcycle, as a protective pair of pants or a protective jacket.

At least a portion of the garment consist in the present fabric. In other words, for at least part of the fabric, the inner surface of the fabric coincides with the inner surface of the garment, as well as the outer surface of the fabric coincides with the outer surface of the fabric, such that no other layers of fabrics are superimposed to the fabric of the present invention for at least part of the garment. In other words, at least a portion of the garment is made of a single layer fabric according to the present invention.

When tested with EN 17092, this fabric was classified as an AAA fabric.

The invention claimed is:

1. A woven fabric having warp yarns and weft yarns, wherein said warp yarns and said weft yarns each comprise a core and a sheath, said core comprising a first core component and a second core component, wherein the first core component has a breaking tenacity of at least 10 g/den and comprises UHMWPE, wherein the second core component comprises elastomeric elements, and wherein elasticity of the fabric in warp direction is at least 20% and elasticity of the fabric in weft direction is at least 20%, wherein said first core component and said second core component are connected together and remain attached, said woven fabric comprises a warp density between 15 and 70 warps/cm and a weft density between 15 and 50 wefts/cm, and the first core component comprises between 10% and 58.5% of the weight of the respective yarn, the second core component comprises between 1.5% and 40% of the weight of the respective yarn, and the sheath comprises between 40% and 88.5% of the weight of the respective yarn.

2. A woven fabric according to claim 1, wherein the weave of the fabric is a single layer weave.

3. A woven fabric according to claim 1, wherein elasticity of the fabric in weft direction is at least 30% and is greater than the elasticity of the fabric in warp direction.

4. A woven fabric according to claim 1, wherein the elasticity in warp direction is between 25% and 40%.

5. A woven fabric according to claim 1, wherein count of the warp yarns and the weft yarns is comprised between NE 4 and NE 80.

6. A woven fabric according to claim 1, wherein a count of the first core component is between 75 den and 150 den and a count of the second core component is between 70 and 105 den.

7. A woven fabric according to claim 1, wherein warp tensile strength and weft tensile strength in accordance with ASTM D5034, are greater than 50 Kg and warp tear strength and weft tear strength are greater than 10000 g in accordance with ASTM D1424.

8. A garment, wherein at least a portion of the garment is made from the woven fabric according to claim 1.

9. A fabric comprising identical warp and weft yarns, each yarn comprising a core and a sheath, said core comprising a first core component and a second core component, wherein the first core component has a breaking tenacity of at least 10 g/den, and wherein the second core component comprises elastane, wherein said first core component and said second core component are connected together such that they remain attached and wherein the warp and weft yarns each comprise NE 10/1 yarns, the first core component comprises a 150 den UHMWPE yarn and the second core component comprises an elastane yarn between 20 and 500 den, each of the warp and weft yarns comprising 68% cotton, 28.2% UHMWPE and 3.8% elastane by weight.

10. The fabric A yarn according to claim 9, wherein the elongation at break of the first core component is less than 10%.

11. A woven fabric having warp yarns and weft yarns and comprising a warp density between 20 and 60 warps/cm and a weft density between 18 and 40 wefts/cm, said warp yarns and said weft yarns each comprising a core and a sheath, said core comprising a first core component and a second core component, the first core component having a breaking tenacity of at least 10 g/den and the second core component comprising elastomeric elements, wherein:

elasticity of the fabric in warp direction is at least 20% and elasticity of the fabric in weft direction is at least 20%;

the second core component is a single filament yarn;

said woven fabric comprises a weight density between 9 and 22 oz. sq. yd. and a count comprised between NE 4 and NE 80, at least one of said warp yarns and said weft yarns comprise 40-88.5% cotton, 10-60% UHMWPE and 1-5-40% elastane by weight, and said first core component and said second core component are attached to one another at a number of connection points ranging from 50 to 120 points per meter.

12. The woven fabric according to claim 11, wherein elasticity of the fabric in weft direction is at least 30% and is greater than the elasticity of the fabric in warp direction.

13. A garment, wherein at least a portion of the garment is made from the fabric according to claim 9.

14. A woven fabric having warp yarns and weft yarns, wherein said warp yarns and said weft yarns each comprise a core and a sheath, said core comprising a first core component and a second core component, wherein the first core component has a breaking tenacity according to DIN EN ISO 2062, of at least 10 g/den, wherein the second core component comprises elastomeric elements, and wherein elasticity of the fabric in warp direction is at least 20% and elasticity of the fabric in weft direction is at least 20%, wherein said first core component and said second core component are connected together and remain attached, and wherein the fabric comprises a warp pattern of 2b/1a/1b, 1b/1a/2b, 1 a/3b, 3b/1a; wherein "a" is an under portion and "b" is an over portion.

15. A woven fabric according to claim 1, wherein the first core component and a second core component are twisted about 300 twists/meter.

16. A woven fabric having warp yarns and weft yarns and comprising a warp density between 20 and 60 warps/cm and a weft density between 18 and 40 wefts/cm, said warp yarns and said weft yarns each comprising a core and a sheath, said core comprising a first core component and a second core component, the first core component having a breaking tenacity according to DIN EN ISO 2062, of at least 10 g/den and the second core component comprising elastomeric elements, wherein:

elasticity of the fabric in warp direction is at least 20% and elasticity of the fabric in weft direction is at least 20%;

the second core component is a single filament yarn having a count between 20 and 500 den;

said woven fabric comprises a weight density between 9 and 22 oz. sq. yd. and a count comprised between NE 4 and NE 80, and said first core component and said second core component are attached to one another. wherein the fabric comprises a warp pattern of 2b/1a/1b, 1b/1a/2b, 1 a/3b, 3b/1a; wherein "a" is an under portion and "b" is an over portion.

17. The woven fabric according to claim 1, wherein said warp yarns comprise 71.5% cotton, 22.5% UHMWPE and 6% elastane by weight and said weft yarns comprise 60.5% cotton, 28.2% UHMWPE and 11.3% elastane by weight.

18. The woven fabric according to claim 1, wherein said woven fabric comprises 35.8 warps/cm and 22 wefts/cm.

19. The woven fabric according to claim 1, wherein the first core component comprising said UHMWPE having a count of 75 den and the second core component comprises an elastane having a count of 70 den.

20. The woven fabric according to claim 1, wherein the second core component comprises elastane and the warp yarns includes an elastane that is coarser than the elastane of the weft yarns, and a sheath that is finer than the sheath of the weft yarns.

21. The woven fabric according to claim 1, wherein said first core component and said second core component are attached at a number of connection points ranging from 50 to 120 points per meter.

22. The fabric according to claim 9, wherein said first core component and said second core component are connected together at a number of connection points ranging from 50 to 120 points per meter.

23. The woven fabric according to claim 1, wherein a twist multiple of the warp yarns is 3.40, the number of twists per meter of the warp yarns is 535, a twist multiple of the weft yarns is 4.20, and the number of twists per meter of the weft yarns is 828.

* * * * *